US007867379B2

(12) United States Patent
Leta et al.

(10) Patent No.: US 7,867,379 B2
(45) Date of Patent: Jan. 11, 2011

(54) PRODUCTION OF AN UPGRADED STREAM FROM STEAM CRACKER TAR BY ULTRAFILTRATION

(75) Inventors: Daniel P. Leta, Flemington, NJ (US); Edward W. Corcoran, Easton, PA (US); Eric B. Sirota, Flemington, NJ (US); Stephen M. Cundy, Lebanon, NJ (US); Kirk C. Nadler, Houston, TX (US); John Di-Yi Ou, Houston, TX (US); Paul F. Keusenkothen, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 252 days.

(21) Appl. No.: 11/980,162

(22) Filed: Oct. 30, 2007

(65) Prior Publication Data

US 2009/0057200 A1 Mar. 5, 2009

Related U.S. Application Data

(60) Provisional application No. 60/966,472, filed on Aug. 28, 2007.

(51) Int. Cl.
*B01D 61/16* (2006.01)
*C10G 9/36* (2006.01)

(52) U.S. Cl. ..... 208/97; 210/651; 208/130

(58) Field of Classification Search ..... 208/97, 208/130; 210/651
See application file for complete search history.

(56) References Cited

U.S. PATENT DOCUMENTS

| | | | |
|---|---|---|---|
| 2,947,687 | A | 10/1954 | Lee |
| 3,684,697 | A | 8/1972 | Gamson |
| 3,919,075 | A | 11/1975 | Parc et al. |
| 3,990,963 | A | 11/1976 | Audibert et al. |
| 4,115,465 | A | 9/1978 | Elfert et al. |
| 4,120,900 | A | 10/1978 | Evers et al. |
| 4,134,824 | A | 1/1979 | Kamm et al. |
| 4,169,782 | A | 10/1979 | Thompson |
| 4,259,170 | A | 3/1981 | Graham et al. |

(Continued)

FOREIGN PATENT DOCUMENTS

CA 2185264 9/1996

(Continued)

OTHER PUBLICATIONS

V. S. Ravi-Kumar, Theodore T. Tsotsis, Muhammad Sahimi; "Studies of Transport of Asphaltenes through Membranes Using Hindered Diffusion Theories for Spheres and Spheroids," Ind. Eng. Chem. Res. 1997, 36, pp. 3154-3162.

(Continued)

*Primary Examiner*—Walter D Griffin
*Assistant Examiner*—Renee Robinson
(74) *Attorney, Agent, or Firm*—Bruce M. Bordelon

(57) ABSTRACT

This invention relates to a process of producing an upgraded product stream from steam cracker tar feedstream suitable for use in refinery or chemical plant processes or for utilization in fuel oil sales or blending. This process utilizes an ultrafiltration process for separating the steam cracker tar constituents resulting in a high recovery, low-energy process with improved separation and product properties.

17 Claims, 4 Drawing Sheets

U.S. PATENT DOCUMENTS

| | | | |
|---|---|---|---|
| 4,411,790 | A | 10/1983 | Arod et al. |
| 4,504,377 | A | 3/1985 | Shu et al. |
| 4,592,832 | A | 6/1986 | Bristow et al. |
| 4,617,126 | A | 10/1986 | Funk et al. |
| 4,661,241 | A | 4/1987 | Dabkowski et al. |
| 4,797,200 | A | 1/1989 | Osterhuber |
| 4,814,088 | A | 3/1989 | Kutowy et al. |
| 4,816,140 | A | 3/1989 | Trambouze et al. |
| 4,874,523 | A | 10/1989 | LaFreniere |
| 4,892,660 | A | 1/1990 | Sweet |
| 4,908,134 | A | 3/1990 | Anderson |
| 4,946,594 | A | 8/1990 | Thaler et al. |
| 4,963,303 | A | 10/1990 | Anderson |
| 4,978,454 | A | 12/1990 | Sweet |
| 4,982,051 | A | 1/1991 | Pasternak et al. |
| 5,045,206 | A | 9/1991 | Chen et al. |
| 5,045,354 | A | 9/1991 | Feimer et al. |
| 5,107,056 | A | 4/1992 | Chen et al. |
| 5,107,058 | A | 4/1992 | Chen et al. |
| 5,107,059 | A | 4/1992 | Chen et al. |
| 5,173,172 | A | 12/1992 | Adams et al. |
| 5,180,496 | A | 1/1993 | Sartori et al. |
| 5,191,151 | A | 3/1993 | Eriksen et al. |
| 5,256,297 | A | 10/1993 | Feimer et al. |
| 5,514,252 | A | 5/1996 | Kerby, Jr. et al. |
| 5,635,055 | A | 6/1997 | Sweet et al. |
| 5,643,442 | A | 7/1997 | Sweet et al. |
| 5,749,943 | A | 5/1998 | Shimazu et al. |
| 5,785,860 | A | 7/1998 | Smith |
| 5,871,634 | A | 2/1999 | Wiehe et al. |
| 5,979,178 | A | 11/1999 | Engler et al. |
| 6,180,008 | B1 | 1/2001 | White |
| 6,187,987 | B1 | 2/2001 | Chin et al. |
| 6,190,533 | B1 | 2/2001 | Bradow et al. |
| 6,524,469 | B1 | 2/2003 | Schucker |
| 6,525,469 | B1 | 2/2003 | Huang et al. |
| 6,896,796 | B2 | 5/2005 | White et al. |
| 7,018,517 | B2 | 3/2006 | Kurita et al. |
| 7,041,212 | B2 | 5/2006 | White et al. |
| 7,048,846 | B2 | 5/2006 | White et al. |
| 2003/0019790 | A1 | 1/2003 | Schucker |
| 2004/0026321 | A1 | 2/2004 | Minhas et al. |
| 2004/0251166 | A1 | 12/2004 | Baptista et al. |
| 2004/0251201 | A1 | 12/2004 | Chau et al. |
| 2006/0016727 | A1 | 1/2006 | Varadaraj |
| 2006/0231462 | A1 | 10/2006 | Johnson |
| 2007/0090020 | A1 | 4/2007 | Buchanan et al. |
| 2008/0116109 | A1* | 5/2008 | McCoy et al. ..... 208/39 |

FOREIGN PATENT DOCUMENTS

| | | | |
|---|---|---|---|
| EP | 0160142 | | 11/1985 |
| EP | 0254359 | B1 | 1/1988 |
| EP | 0146298 | B1 | 5/1991 |
| EP | 0489573 | B1 | 9/1995 |
| GB | 1266180 | | 12/1969 |
| GB | 2268186 | | 1/1994 |
| JP | 54013509 | | 7/1977 |
| JP | 2000288371 | | 4/1999 |
| JP | 2001038159 | | 8/1999 |
| KR | 2002007235 | | 1/2002 |
| WO | WO 00/06526 | | 2/2000 |
| WO | WO 01/60771 | A1 | 8/2001 |
| WO | WO 02/50212 | A2 | 6/2002 |
| WO | WO 03/026781 | A1 | 4/2003 |
| WO | WO 2004/018067 | A2 | 3/2004 |
| WO | WO 2006/040328 | A1 | 4/2006 |

OTHER PUBLICATIONS

Anna Duong, Goutam Chattopadhyaya, Wellington Y. Kwok, Kevin J. Smith; "An experimental study of heavy oil ultrafiltration using ceramic membranes," Fuel, vol. 76, No. 9, pp. 821-828, 1997.

B. D. Sparks, J. D. Hazlett, O. Kutowy, T. A. Tweddle; "Upgrading of Solvent Extracted Athabasca Bitumen by Membrane Ultrafiltration," AIChe Journal, Aug. 1990, vol. 36, No. 8, pp. 1279-1282.

Bruce Bishop, Robert Goldsmith, Robert Schucker, Keith Rawlins; "Ceramic Membrane Process for Upgrading Vacuum Residual Oil," Presentation at AIChE 2004 Spring Annual Meeting, New Orleans, LA, Apr. 25-29, 89d.

W. C. Lai, K. J. Smith; "Heavy oil microfiltration using ceramic monolith membranes," Fuel 80 (2001) pp. 1121-1130.

J. D. Hazlett, O. Kutowy, T. A. Tweddle, B. A. Farnand; "Processing of crude oils with polymeric ultrafiltration membranes," AIChE 1989 Spring National Meeting (Houston Apr. 2-6, 1989) AIChE Symposium Series V85 N. 272, 101-107 (1989).

Deqing Shi, Hongwei Yu, Jinrong Yang, Zhihau Zhang,Ying Kong; "Study on the separation performance of polyimide nanofiltration membrane for solvent recovery in the butanone-toluene dewaxing process of lube oil," Mo Kexue Yu Jishu (2005), 25(3), 50-53, 62. Abstract.

Zhi-Ping Zhao, Jiding Li, Jian Chen, Cui-Xian Chem; "Nanofiltration membrane prepared from polyacrylonitrile ultrafiltration membrane by low-temperature plasma," Journal of Membrane Science (2005), 251(1-2), 239-245. Abstract.

F. Petrus Cuperus, Katrin Ebert; "Non-aqueous application of NF," Nanofiltration (2005), 521-536, Editor(s): Schafer, A.I.; Fane, A.G.; Waite, Thomas D., Publisher: Elsevier Ltd., Oxford, UK. Abstract.

B. Bishop, R. Goldsmith, R. Schucker, K. Rawlins; "Ceramic membrane process for upgrading vacuum residual oil," 2004 AIChE Spring Meeting, Conference Proceedings, New Orleans, LA, 7p (2004) Abstract.

M. V. Veazey; "Tech trends: Microfiltration system," Materials Performance 43/5 15 (May 2004), Abstract.

T. Melin, M. Gallenkemper, J. Hoppe, C. Matthias, "Achema reports. Membrane engineering," Chemie-Ingenieur-Technik (Achema 2003 27(sup) t(sup) h International Exhibition-Congress on Chemical Engineering, 76/12 1869-1876, Dec. 2003., Abstract.

V. I. Il'In, V. A. Kolesnikov, A. V. D'Yachenko; "Electrically insulating petroleum oils and their refining," Oboronnyi Kompleks—Nauchno-Tekhnicheskomu Progressu Rossii (2002), (4), 69-71. Abstract.

A. P. Aleksandrin, A. A. Egorshev, O. V. Katsereva, E. A. Komyagin, V. N. Mynin, G. V. Terpugov; "Use of ceramic membranes for treatment end regeneration of depleted petroleum products," Tyazh. Mashinostr. -/6 30-32 (2002) Chemical Abstracts 138/5-6 Abstr. No. 58512 (2003). Abstract.

"Process industries exposition: Membrane rejects emulsified oils while maintaining hydrophilic properties," Chemical Engineering Progress 97/4 26 (Apr. 2001). Abstract.

K. J. Smith, W. C. Lai; "Heavy oil microfiltration using ceramic monolith membranes," Fuel, 80/8, 1121-1130 (Jun. 2001). Abstract.

R. M. Gould, L. S. White, C. R. Wildemuth; "Membrane separation in solvent lube dewaxing," Environmental Progress, 20/1, 12-16 (Apr. 2001). Abstract.

N. A. Bhore, R. M. Gould, S. M. Jacob, P. O. Staffeld, D. McNally, P. H. Smiley, C. R. Wildemuth; "New membrane process debottlenecks solvent dewaxing unit," Oil and Gas Journal, 97/46, 67-68, 70, 72-24 (1999 1115). Abstract.

Jiao-Li Li, Xu-Xiang Li, Bing-Hua Ni; "Development of ultrafiltration and its application in recovery of dewaxing solvent," Shihua Jishu Yu Yingyong (2000), 18(5), 295-297, 301. Abstract.

S. Elmaleh, N. Ghaffor; "Upgrading oil refinery effluents by cross-flow ultrafiltration," Water Science & Technology, 34(9), 231-238 (1996), Aqualine Abstracts Abstr. No. 97-4463 V13 N.9 (Sep. 1997). Abstract.

B. Park, V. S. Ravi-Kumar, T. T. Tsotsis; "Models and simulation of liquid—phase membrane reactors," Industrial & Engineering Chemistry Research, V37 N. 4, 1276-89 (Apr. 1998). Abstract.

A. Duong, K. J. Smith; "A model of ceramic membrane fouling during heavy oil," Canadian Journal of Chemical Engineering, V75 N. 6, 1122-29 (Dec. 1997). Abstract.

M. Garcia Sanchez, J. L. Perez Pavon, B. Moreno Cordero; J. Chromatogr., A, 766 (1+2), 61-69 (1997) Chemical Abstracts Abstr. No. 319181 V126 N. 24. Abstract.

V. S. Ravi-Kumar, T. T. Tsotsis, M. Sahimi; "Studies of the transport of asphaltenes through membranes using hindered diffusion theories for spheres and spheroids," Industrial & Engineering Chemistry Research, V36 N. 8, 3154-62 (Aug. 1997). Abstract.

V. S. Ravi-Kumar, L. Yang, T. T. Tsotsis; "Liquid-phase reactive applications with inorganic membranes : Models and experiments," ACS 214$^{th}$ National Meeting (Las Vegas Sep. 7-11, 1997) Book of Abstracts Part 2 Abstr. No. PMSE-273 (1997). Abstract.

A. Duong, G. Chattopadhyaya, W. Y. Kwok, K. J. Smith; "An experimental study [using Cold Lake (Alberta) oil] of heavy oil ultrafiltration using [single-tube] ceramic membranes," Fuel, V76, N. 9, 821-28 (Jul. 1997). Abstract.

S. Elmaleh, N. Ghaffor; "Upgrading oil refinery effluents by cross-flow ultrafiltration," Water Sci. Technol., 34(9), Water Quality International '96 Part (2), 231-238 (1996) Chemical Abstracts Abstr. No. 79315, V126 N. 6. Abstract.

E. Beaver, Siegel; 'Technologies critical to a changing world / Clean technologies), AIChE et al. 5$^{th}$ World Chemical Engineering Congress (San Diego Jul. 14-18, 1996) Summary Proceedings 100-03, 159-61 (Oct. 1996). Abstract.

W. Ying, B. Tansel; "Effect of coagulation on fouling rate and cleanability of ultrafiltration membranes," Purdue University 50$^{th}$ Industrial Waste Conference (West Lafayette, IN May 8-10, 1996) Proceedings 285-95 (1995). Abstract.

J. L. Humphrey; "Separation processes: Playing a critical role," Chemical Engineering Progress, V91, N. 10, 31-41 (Oct. 1995). Abstract.

V. N. Zrelov, N. G. Postnikova, L. V. Krasnaya; "Rapid membrane (diffusion) methods for determining mechanical impurities in liquid petroleum products," Khimiya I Tekhnologiya Topliv i Masel, N. 4, 28-30 (1994). Abstract.

B. D. Sparks, J. D. Hazlett, O. Kutowy, T. A. Tweddle, Union Carbide Corp.; "Upgrading of solvent extracted *Athabasca bitumen* by membrane ultrafiltration," AIChE Journal V36, N. 8, 1279-82 (Aug. 1990). Abstract.

R. J. Torres-Ordonez, S. G. Kukes, F. S. Lee, D. C. Cronauer; "Characterization of solids from coal/resid(ue) coprocessing," ACS 200$^{th}$ National Meeting (Washington, DC Aug. 26-31, 1990) ACS Division of Fuel Chemistry Preprints V35 N.4, 1048-55 (1990). Abstract.

J. D. Hazlett, O. Kutowy, T. A. Tweddle, B. A.Farnand; "Processing of Crude Oils with Polymeric Ultrafiltration Membranes," Nat'l. Res. Counc. Can.; Can. Cent. Miner. Energy Technol, 1989 AIChE Spring Nat'l Meeting (Houston Apr. 2-6, 1989), Prepr. N. 64f 18P.

B. D. Sparks, J. D. Hazlett, O. Kutowy, T. A. Tweddle; "Upgrading of solvent extracted *Athabasca bitumen* by Membrane ultrafiltration," AIChE 1987 Summer Natl. Meet. (Minneapolis 816-19/87 Prepr. N. 7D 22P. Abstract.

M. Nishimura; "Application and development of membrane separation processes in oil chemistry and its related fields," Yakagaku, 34(3), 171-7 (1985), Chem. Abstr. Abstr. No. 168846 V102 N. 20. Abstract.

D. S. Schuster, C. A. Irani; "Understanding the pour point depression mechanism—2, microfiltration analysis of crude oils," 189$^{th}$ ACS Natl. Meet. (Miami Beach Apr. 28-May 3, 1985) ACS Div. Fuel Chem. Prepr. V30 N.1, 169-77 (1985). Abstract.

J. Durandet; "Separation (Processes) in the refining industry/introduction separations dans le raffinage/introduction," Pet. Tech. N.298 5-6 (May 1983). Abstract.

J. Briant, G. Hotier; "The state of asphaltenes in hydrocarbon mixtures the size of molecular clusters," Rev. Inst. Fr. Pet. V38 N.1 83-100 (Jan.-Feb. 1983). Abstract.

D. Defives, R. Avrillon, C. Miniscloux, R. Roullet, X. Marze; "Regeneration of used lubricating oils by ultrafiltration," Informations Chimie (1978), 175, 127-31. Abstract.

A. Duong, K. Smith, JCS University of British Columbia; Canadian Journal of Chemical Engineering V75 N. 6, 1122-29 (Dec. 1997). Abstract.

V. N. Zrelov, N. G. Postnikova, L. V. Krasnaya; "Analytical filtration of petroleum and synthetic products through membranes," Khim. Tekhnol. Topl. Masel (1984), (11), 32-4. Abstract.

R. J. Thrash, R. H. Pildes; "The diffusion of Petroleum asphaltenes (from a Middle East high-sulfur vacuum residuum) through well characterized (MICA) porous membranes," 181$^{st}$ ACS Natl. Meet (Atlanta Mar. 29-Apr. 3, 1981) ACT Div. Pet. Chem. Prepr. V26 N.2515-25 (Mar. 1981). Abstract.

D. D. Spatz; "Ultrafiltration . . . The membranes, the process, and its application to organic molecule fractionation (Including industrial oil/water separations," 178$^{th}$ ACS Natl. Meet. (Washington, DC Sep. 9-14, 1979) Abstr. PAP. Abstr No. COLL-125. Abstract.

G. Sartori, W. S. Ho, R. E. Noone, B. H. Ballinger; "(New) poly(fluoroolefin) membranes for aromatics/saturates separation," AIChE 1997 Annual Meeting (Los Angeles Nov. 16-21, 1997) Preprint N.32d 6P. Abstract.

V. S. Ravi-Kumar, I. A. Webster, T. T. Tsotsis, R. C. Sane, M. Sahimi; "Studies of diffusion of petroleum liquid macromolecules through model membranes," AIChE 1992 Annual Meeting (Miami Beach Nov. 1-5, 1992) Preprint N.22g 3P. Abstract.

R. C. Sane, I. A. Webster, T. T. Tsotsis, V. S. Ravi-Kumar; "Studies of asphaltene diffusion and structure and their implications for resid(uum) upgrading," 12$^{th}$ International "Chemical Reaction Engineering Today" Symposium (Turin, Italy Jun. 28-Jul. 1, 1992) Chemical Engineering Science V47 N.9-11 2683-88 (Jun.-Aug. 1992). Abstract.

R. C. Sane; "The diffusion of petroleum asphaltenes in porous membranes," University of Southern California, Dissertation (1991) (Abstract) Dissertation Abstracts International: Section B Science & Engineering V52 N.8 4350-B (Feb. 1992). Abstract.

Yong Woo Rho, Hwayong Kim, Won Hee Park; "Effect of oil viscosity on ultrafiltration flux," Hwahak Konghak (1989), 27(4), 446-50. Abstract.

Yujun Song, Fuan Liu, Yong Yang, Jian Zou, Benhui Sun, Tianyuan Zhong; "Review on the preparation and application of nanofiltration membrane," Huagong Keji (1999), 7(3), 1-7. Abstract.

May-Britt Haag; "Membranes in chemical processing. A review of applications and novel developments," Separation and Purification Methods (1998), 27(1), 51-168. Abstract.

H. Zuern, K. Kohlhase,K. Hedden, J. Weitkamp; "Developments in refinery technology—1. Process technology, processing of crudes, residua, and heavy oils," 50$^{th}$ DGMK Anniv. Meet (Berline Nov. 24-26, 1983) Erdoel Kohle, Erdgas, Petrochem. Brennst. Chem. V37 N.2 52-69 (Feb 1984). Abstract.

R. E. Baltus, J. L. Anderson; "Hindered diffusion of asphaltenes through microporous membranres," Chemical Engineering Science (1983), 38(12) 1959-69. Abstract.

A. Duong, K. J. Smith; "A model of ceramic membrane fouling during heavy oil ultrafiltration," Canadian Journal of Chemical Engineering V75 N.6 1122-29 (Dec. 1997). Abstract.

* cited by examiner

PRODUCTION OF AN UPGRADED STREAM FROM STEAM CRACKER TAR BY ULTRAFILTRATION

This application claims the benefit of U.S. Provisional Application No. 60/966,472 filed Aug. 28, 2007.

FIELD OF THE INVENTION

This invention relates to a process of producing an upgraded product stream from steam cracker tar feedstream suitable for use in refinery or chemical plant processes or for utilization in fuel oil sales or blending. This process utilizes an ultrafiltration process for separating the steam cracker tar constituents resulting in a high recovery, low-energy process with improved separation and product properties.

BACKGROUND OF THE INVENTION

The steam cracking processes for the production of ethylene are common petrochemical processes. These processes are practiced throughout the world with millions of tons of ethylene product being produced annually. The ethylene steam cracking process typically involves thermally cracking a feedstock (such as ethane, propane, naphtha, gas oils, or even higher boiling point feedstocks) in a furnace at very high temperatures normally in the range of about 1382 to about 1742° F. (750 to 950° C.) in the presence of steam followed by rapidly cooling the thermally cracked stream to produce a product stream comprising ethylene.

Although it is desired to maximize the amount of ethylene produced in the process, many other compounds are produced as a byproduct of the cracking process. These byproducts generally range from elemental hydrogen, $H_2$, as well as light hydrocarbon components, such as $C_1$-$C_4$ hydrocarbons to heavier hydrocarbon compounds including naphtha range materials and heavy oils including steam cracker tar.

The steam cracker tar is a high molecular weight, highly aromatic product that results from the production of ethylene. The steam cracker tar is the heavy fraction or "bottoms" fraction of the product produced by a steam cracking process typically with an initial boiling point of about 550° F. (288° C.). The amount of steam cracker tar that is produced is dependent upon the actual configuration of the ethylene steam cracker unit, but is also dependent upon the initial feed content utilized in the process. In general, the heavier the feedstock to the ethylene steam cracking process, the more heavy oils including steam cracker tar is produced. While it is preferable to use a light feedstock such as ethane, natural gas, or naphtha, the more limited availability and higher costs of these lighter ethylene cracker feedstocks have driven the ethylene cracking economics toward the use of heavier, higher molecular weight feed compositions to meet the growing demand for ethylene production. One significant drawback to utilizing a heavy feedstock such as a gas oil as the feedstream, is that the amount of steam cracker tar produced by the process can be significant and the product stream from the ethylene steam cracker furnace can contain more than about 15 wt % to more than 40 wt % steam cracker tar boiling range material.

This steam cracker tar product generally boils in the range from about 550 to about 1500° F. (288 to 816° C.) and has significant asphaltene content. Steam cracker tar is preferably sold as a fuel oil or bunker fuel but due to its high aromatic and asphaltene content the steam cracker tar stream can encounter compatibility problems with being blended with other fuel oils and bunker fuels and therefore often needs to be segregated and sold as a separate downgraded fuel product. This presents significant additional storage logistics and costs to a refiner over being able to blend the steam cracker tar into the standard fuel oil or bunker fuel product pool.

Therefore, there exists in the industry a need for an improved process for improving the properties of steam cracker tars for use as a blend stock for fuel oils or bunker fuels.

SUMMARY OF THE INVENTION

The invention includes a process for improving the properties of a steam cracker tar feedstream for use in subsequent petrochemical processes or as a compatible blend stock for fuel oil or bunker fuels.

One embodiment of the present invention is a process for producing a product stream from a steam cracked hydrocarbon feed stream comprising:

a) thermally cracking a hydrocarbon feed stream in the presence of steam in an ethylene steam cracker furnace at a temperature of at least 1382° F. (750° C.) to produce a cracked product stream;

b) cooling the cracked product stream to a temperature below 1382° F. (750° C.);

c) fractionating the cracked product stream to produce at least a first fractionated product stream and a second fractionated product stream, wherein the second fractionated product stream has a higher final boiling point than the first fractionated product stream and the second fractionated product stream has a final boiling point greater than 1000° F. (538° C.);

d) inputting the second fractionated product stream into a membrane system wherein the second fractionated product stream contacts a first side of at least a first membrane;

e) passing a portion of the second fractionated product stream from the first side of the first membrane, through the first membrane, to the a second side of the first membrane;

f) retrieving at least a first permeate stream from the second side of the first membrane; and g) retrieving at least a first retentate stream from the first side of the first membrane;

wherein the first permeate stream has a Micro Carbon Residue wt % that is at least 25% lower than the Micro Carbon Residue wt % of the second fractionated product stream.

In a preferred embodiment, the second fractionated product stream is comprised of an ethylene steam cracker tar. In yet another embodiment, the process produces a first permeate stream wherein the Insolubility Number ("$I_N$") is at least 20% lower than the Insolubility Number ("$I_N$") of the second fractionated product stream.

In still other preferred embodiments, the first membrane utilized in the membrane separations process has an average pore size from about 0.001 microns to about 2 microns, and in yet another embodiment, the transmembrane pressure across the first membrane in the process is from about 100 psig to about 1500 psig.

DETAILED DESCRIPTION OF THE PREFERRED EMBODIMENTS

This invention is a process for improving the properties of an ethylene steam cracker tar feedstream for use in subsequent petrochemical processes or as a compatible blend stock for fuel oil or bunker fuels.

What has been discovered is the use of an ultrafiltration process to produce an ethylene steam cracker tar product stream that possesses a reduced Micro Carbon Residue (MCR) or Conradson Carbon Number (CCR) which herein are taken as equivalents, reduced asphaltenes, reduced average molecular weight and an improved Insolubility Number ("$I_N$") (as determined by the "Wiehe" Method) for use as a fuel oil or bunker fuel blend stock. Additionally, the increased MCR, increased asphaltene product produced as a retentate product of the current invention may be used is such petrochemical processes us partial oxidation (POX) or in carbon black production.

The term "Micro Carbon Residue" (or "MCR") as used herein is a measure of carbon content of a sample as measured per test method ASTM D4530. The terms "Micro Carbon Residue" ("MCR") and "Conradson Carbon Residue" ("CCR") are considered as equivalent values as used herein and these terms are utilized interchangeably herein.

The term "average boiling point" as used herein is defined as the mass weighted average boiling point of the molecules in a mixture. The term "initial boiling point" as used herein is defined as the temperature at which 5 wt % of the mixture is volatized at atmospheric (standard) pressure. The term "final boiling point" as used herein is defined as the temperature at which 95 wt % of the mixture is volatized at atmospheric (standard) pressure.

The term "transmembrane pressure" as used herein is defined as the difference in pressure as measured across a membrane element being the difference in pressure between the higher pressure feed/retentate side of the membrane element and the lower pressure permeate side of the membrane elements.

Figure 1:
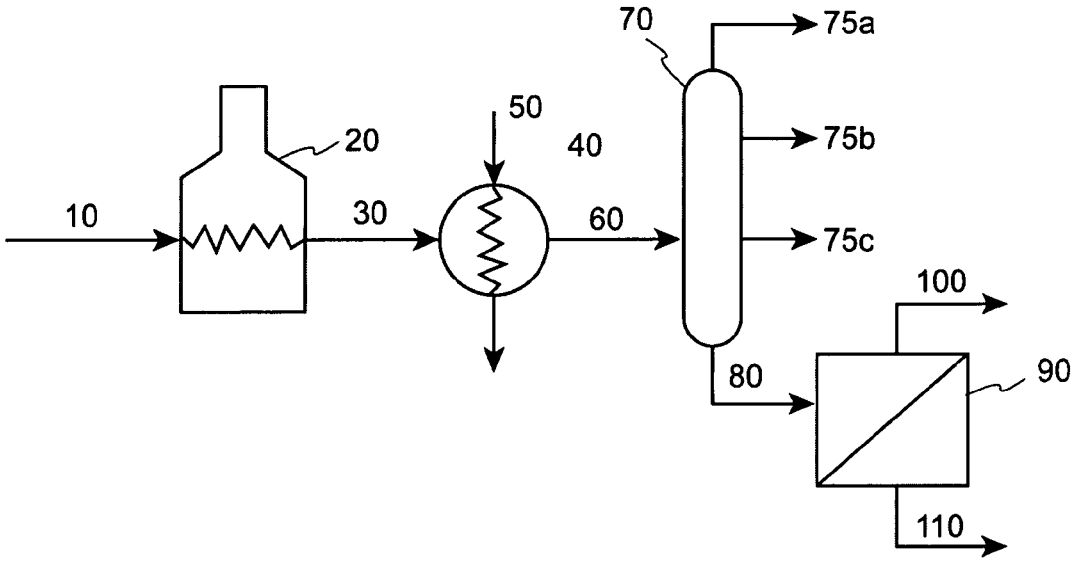
FIG. 1 hereof illustrates an embodiment of the current invention wherein the steam cracker tar stream is separated utilizing ultrafiltration.

FIG. 1 depicts one embodiment of the process of the current invention. Here, the an ethylene steam cracker feedstream (10) is sent to an ethylene cracking furnace (20) where the feedstream is raised to a reaction temperature of about 750-950° C. for about 0.1 to 2 seconds, preferably about 0.2 to about 1 second and the reaction products (30) are then quickly cooled in an ethylene product heat exchanger (40) to reduce the product temperature below the thermal cracking temperatures. The ethylene product heat exchanger can use a cooling stream (50) comprised of any suitable cooling medium but preferably utilizes water as a cooling medium to ensure rapid cooling of the ethylene product stream. This cooled ethylene steam product (60) is then separated into different boiling point fractions by conventional separation equipment such as flash drums and/or distillation towers where the reaction products are separated into boiling point fractions. This step may include a single or multiple distillation columns in parallel and/or series. For simplicity, this fractionation step is simply shown as a distillation column (70) in FIG. 1. Streams (75*a*), (75*b*), and (75*c*) are shown for illustrative purposes to indicate non-condensable and lower boiling point fractionations that may be removed as products from this fractionation stage. These lower boiling point fractions that are removed from the ethylene steam cracker product stream will comprise the light fractions of the product including hydrogen, light hydrocarbons, and naphthas and possibly some gas oils. The heaviest fraction separated from the ethylene steam cracking products in this fractionation step is commonly called "steam cracker tar" (80) and has a high initial boiling point of greater than about 550° F. (288° C.), a high viscosity and a high asphaltene content, which can vary depending on the steam cracker feed selection, steam cracker severity, and the cut point of the stream cracker tar product. The steam cracker tar may also be mixed with a steam cracker gas oil fraction with a nominal boiling point of about 300 to about 550° F. (149 to 288° C.) to improve the viscosity and density characteristics of the steam cracker tar stream.

In accordance with the present invention, the steam cracker tar stream (80) is then sent to a membrane system (90) wherein the stream contacts at least one membrane and a steam cracker tar retentate stream (100) and a separated steam cracker tar permeate stream (110) are removed from the membrane system. In a preferred embodiment, the steam cracker tar permeate stream, containing reduced levels of asphaltenes and hence producing improved blending compatibility characteristics is blended into a fuel oil or bunker fuel product. In a preferred embodiment, the composition of the steam cracker tar permeate stream is sufficiently improved by the current invention to be sold directly as a fuel oil or a bunker fuel product. In yet another preferred embodiment, the steam cracker tar retentate stream is sent as feed to either a partial oxidation (POX) process or for the manufacture of carbon black.

It is preferred that the membranes utilized in the present invention be constructed of such materials and designed so as to withstand prolonged operation at elevated temperatures and transmembrane pressures. In one embodiment of the present invention the membrane is comprised of a material selected from a ceramic, a metal, a glass, a polymer, or combinations thereof. In another embodiment, the membrane comprised of a material selected from a ceramic, a metal, or combination of ceramic and metal materials. Particular polymers that may be useful in embodiments of the present invention are polymers comprised of polyimides, polyamides, and/or polytetrafluoroethylenes provided that the membrane material chosen is sufficiently stable at the operating temperature of the separations process. In preferred embodiments, the membrane material has an average pore size of about 0.001 to about 2 microns (μm), more preferably about 0.002 to about 1 micron, and even more preferably about 0.004 to about 0.1 microns.

In a preferred embodiment of the present invention, the temperature of the steam cracker tar stream prior to contacting the membrane system is at a temperature of about 212 to about 662° F. (100 to about 350° C.), more preferably from about 212 to about 572° F. (100 to about 300° C.), and even more preferably from about 302 to about 482° F. (150 to about 250° C.). The transmembrane pressure may vary considerably depending on the selectivity and the flux rates that are desired, but it is preferred if the transmembrane pressure is from about 100 to about 1500 psig, more preferably from about 250 to about 1200 psig and even more preferably from about 500 to about 1000 psig.

In a preferred embodiment, the heavy hydrocarbon feedstream is flowed across the face of the membrane element(s) in a "cross-flow" configuration. In this embodiment, in the retentate zone, the heavy hydrocarbon feed contacts one end of the membrane element and flows across the membrane, while a retentate product stream is withdrawn from the other end of the retentate zone. As the feedstream/retentate flows across the face of the membrane, a composition selective in saturated compounds content flows through the membrane to the permeate zone wherein it is drawn off as a permeate product stream. In a cross-flow configuration, it is preferable that the Reynolds number in at least one retentate zone of the membrane separations unit be in the turbulent range, preferably above about 2000, and more preferably, above about 4000. In some embodiments, a portion of a retentate stream obtained from the membrane separation units may be recycled and mixed with the feedstream to the membrane separations unit prior to contacting the active membrane.

The Examples below illustrate the improved product qualities and the benefits of the current invention for producing an improved product stream from a steam cracker tar.

EXAMPLES

Example 1

In this Example, a sample of a stream cracker tar was permeated in a batch membrane process using a 8 kD (kiloDalton) cutoff ceramic ultrafiltration membrane, which had an average pore size of approximately 0.008 microns. The transmembrane pressure was held at 700 psi and the feed temperature was 75° C. The flux rates as well as the feed, permeates and retentate wt % Micro Carbon Residue (MCR) values are shown in Table 1. The feed supplied in a closed batch cell which was constantly stirred and was tested at the beginning and the end of the test cycle for wt % MCR per test method ASTM D4530. The permeate samples taken at given intervals and select permeate samples were tested for wt % MCR.

As can be seen from Table 1, the initial Permeate Sample 1 as compared to the Initial Feed shows a 77.4% reduction in Micro Carbon Residue. It can be also be seen in the "MCR (wt %)" column in Table 1 that as the permeate was removed from the system the feed composition in the batch cell increased from 21.36 wt % MCR in the initial feed to a final 27.68 wt % MCR in the final feed. Comparing the last permeate sample tested for MCR (Permeate Sample 4) to the retentate wt % MCR shows the separation achieved an 82.4% reduction in Micro Carbon Residue reduction in the final stages. This shows that the separation process remained essentially stable (with a slight improvement) over the test period.

As seen from the test data of this example, a preferred embodiment of the present invention can achieve a wt % reduction in Micro Carbon Residue of the permeate as compared to the feed of at least 25%, more preferably 40%, and even more preferably 60%.

Figure 2:
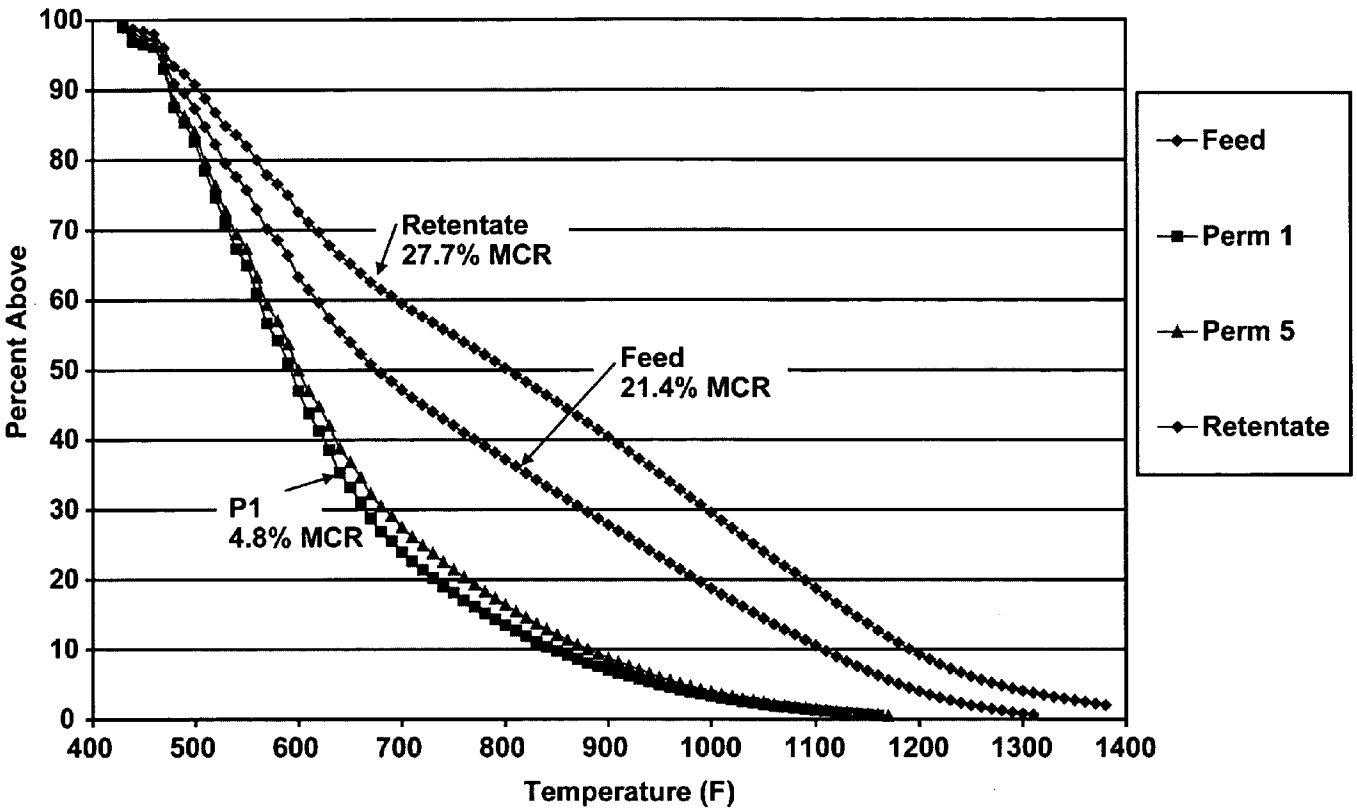
FIG. 2 hereof shows the boiling point curves for the feed, retentate and select permeate streams from the tests performed in Example 1 for separating a steam cracker feed in accordance with one embodiment of the present invention.

Another improvement in the steam cracker tar permeate overall boiling point range of the materials has been decreased. This is shown in FIG. 2 which is a simulated distillation (SIMDIS) by gas chromatography of the corresponding samples from Table 1 above. It can be seen that the boiling point distributions corresponding to the permeate samples at the beginning of run ("Permeate 1") and at the end of run ("Permeate 5") are very consistent. A particular benefit that can be seen from the data in FIG. 2, is that the final boiling points of the permeates have been decreased from greater than 1300° F. to less than 1200° F. In a preferred embodiment of the present invention, the final boiling point of the steam cracker tar permeate is less than 1200° F.

Example 2

A similar steam cracker tar sample and 8 kD (kiloDalton) cutoff ceramic ultrafiltration membrane configuration to those utilized in Example 1 were utilized in Example 2 to test the effects of temperature on the steam cracker tar separation process of the current invention. In this Example, the transmembrane pressure was held at 700 psi and the feed temperature was ranged from 75° C. to 150° C. A similar testing configuration as utilized in Example 1 was used in this example wherein the feed was supplied in a closed batch cell which was constantly stirred during the testing cycle. The feed temperatures and permeate flux rates as well as the feed, retentate, and select permeate wt % Micro Carbon Residue (MCR) values are shown in Table 2. The permeate samples taken at given intervals and select permeate samples as well as the final retentate were also tested for wt % MCR per test method ASTM D4530.

TABLE 1

| Sample | Permeate Flux Rate (gal/ft$^2$/day) | Permeate Yield (% of feed) | MCR (wt %) | % Reduction of MCR (compared to the feed) | % Reduction of MCR (compared to the retentate) |
|---|---|---|---|---|---|
| Initial Feed | | | 21.36 | | |
| Permeate Sample 1 | 0.12 | 7.2 | 4.82 | 77.4 | |
| Permeate Sample 2 | 0.07 | 15.0 | | | |
| Permeate Sample 3 | 0.04 | 21.5 | | | |
| Permeate Sample 4 | 0.03 | 25.4 | 4.87 | 77.2 | 82.4 |
| Permeate Sample 5 | 0.02 | 27.9 | | | |
| Retentate | | | 27.68 | | |

TABLE 2

| Sample | Feed Temp (° C.) | Permeate Flux Rate (gal/ft$^2$/day) | Permeate Yield (% of feed) | MCR (wt %) | % Reduction of MCR (compared to the feed) | % Reduction of MCR (compared to the retentate) |
|---|---|---|---|---|---|---|
| Initial Feed | | | | 18.13 | | |
| Permeate Sample 1 | 75 | 0.11 | 5.1 | 3.06 | 83.12 | |
| Permeate Sample 2 | 75 | 0.06 | 10.7 | | | |
| Permeate Sample 3 | 75 | 0.04 | 11.5 | | | |
| Permeate Sample 4 | 100 | 0.12 | 15.5 | | | |
| Permeate Sample 5 | 100 | 0.07 | 20.8 | | | |
| Permeate Sample 6 | 100 | 0.04 | 29.7 | | | |
| Permeate Sample 7 | 125 | 0.08 | 37.1 | | | |
| Permeate Sample 8 | 150 | 0.11 | 44.8 | | | |
| Permeate Sample 9 | 150 | 0.08 | 56.7 | | | |
| Permeate Sample 10 | 150 | 0.03 | 63.7 | 12.21 | 32.65 | 65.67 |
| Retentate | | | | 35.57 | | |

As can be seen from Table 2, the initial Permeate Sample 1 as compared to the Initial Feed shows a 83.12% reduction in Micro Carbon Residue. This Permeate Sample 1 was run at a feed temperature of 75° C. The final Permeate Sample 10, which was run under a feed temperature of 150° C., shows a decrease in the % Reduction of Micro Carbon Residue of about 65.67% as compared with the final retentate. This indicates that there is some loss in efficiency of MCR reduction as the temperature of the feed increases. Conversely, it can be seen by viewing the "Permeate Flux Rate" column of Table 2, that at each temperature increase, a corresponding increase in the flux rate was experienced. Therefore, there is an optimal feed temperature that may be selected for a given feed depending upon the product quality desired and the volumetric recovery rate desired for the permeate and/or retentate product.

As seen from the test data of this example, a preferred embodiment of the present invention can achieve a wt % reduction in Micro Carbon Residue of the permeate as compared to the feed of at least 25%, more preferably 30%, even more preferably 50%, and even more preferably 70%.

Figure 3:
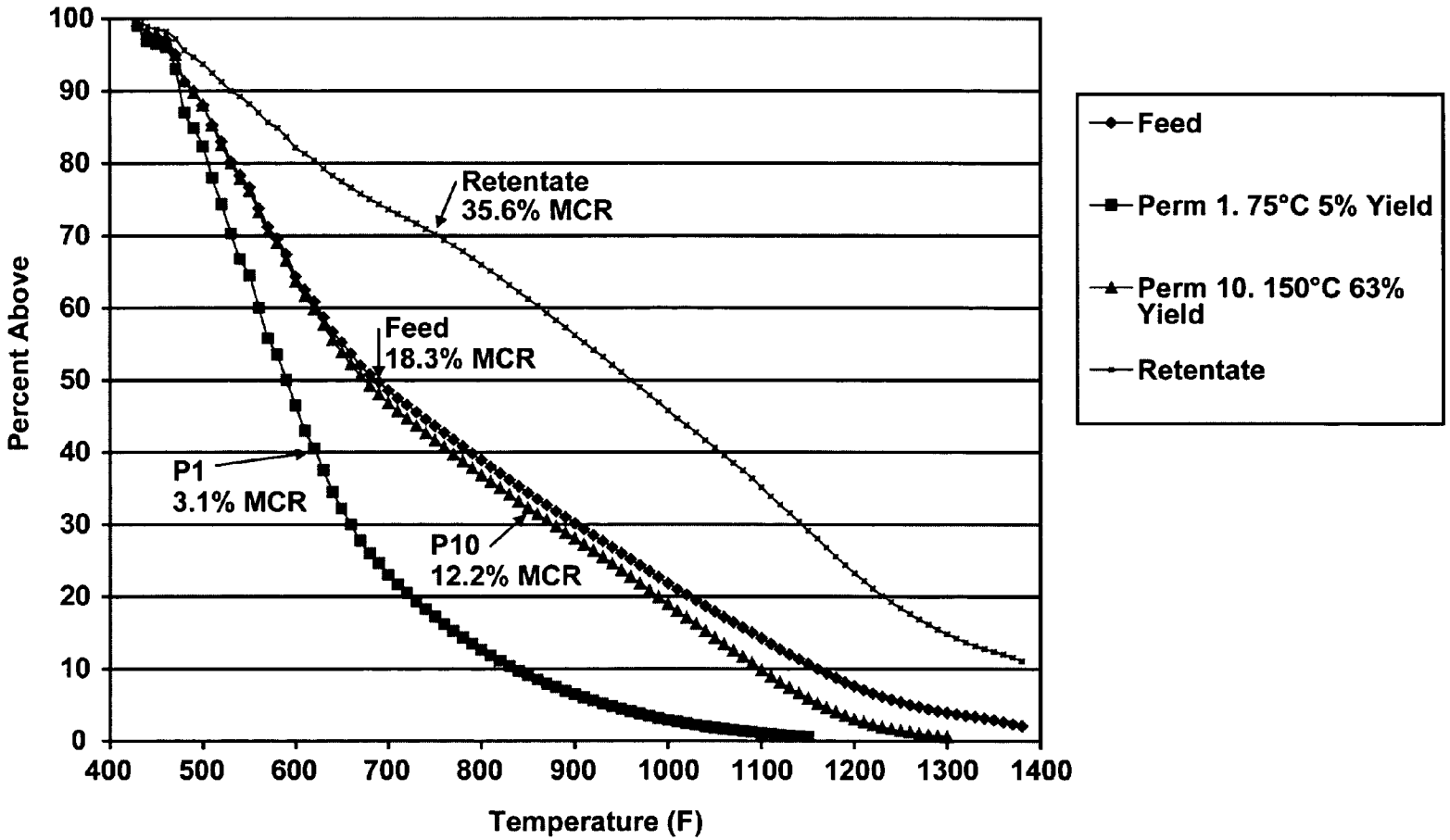
FIG. 3 hereof shows the boiling point curves for the feed, retentate and select permeate streams from the tests performed in Example 2 for separating a steam cracker feed in accordance with one embodiment of the present invention.

FIG. 3 shows the SIMDIS results corresponding to the samples from Table 2 above. It can be seen that the boiling point distributions corresponding to the permeate samples at the beginning of run ("Permeate 1") which was run at a feed temperature of 75° C. and at the end of run ("Permeate 10") which was run at a feed temperature of 150° C. produce different boiling point reductions in the permeate. The boiling point distribution of Permeate 1 is very similar to the results (and test conditions) as shown in Example 1. It can be seen in FIG. 3, similar to Example 1, that the average boiling point of the permeate is considerably lower than that of the feed (as shown by the difference in the curves) and that the final boiling points of the permeate was decreased from greater than 1300° F. to less than 1200° F.

In contrast, the average boiling point of the permeate run at a feed temperature of 150° C. shows little difference from the average boiling point of the feed stream (as shown by the similarity of the SIMDIS curves in FIG. 3), but shows a slight improvement in final boiling point reduction. However, the permeate obtained by the present invention at a feed temperature of 150° C. ("Permeate 10") still shows a significant reduction in wt % MCR as compared to either the feed or the retentate (32.65% reduction and 65.67% reduction, respectively). It should be noted that this final permeate sample produced (Permeate Sample 10) was the permeate produced from a very high boiling retentate on the feed side of the membrane. Thus while this permeate shows only a marginally lower boiling point curve than the original fresh feed, it has a significantly lower boiling point curve than the final retentate composition from which it was separated.

Example 3

Figure 4:
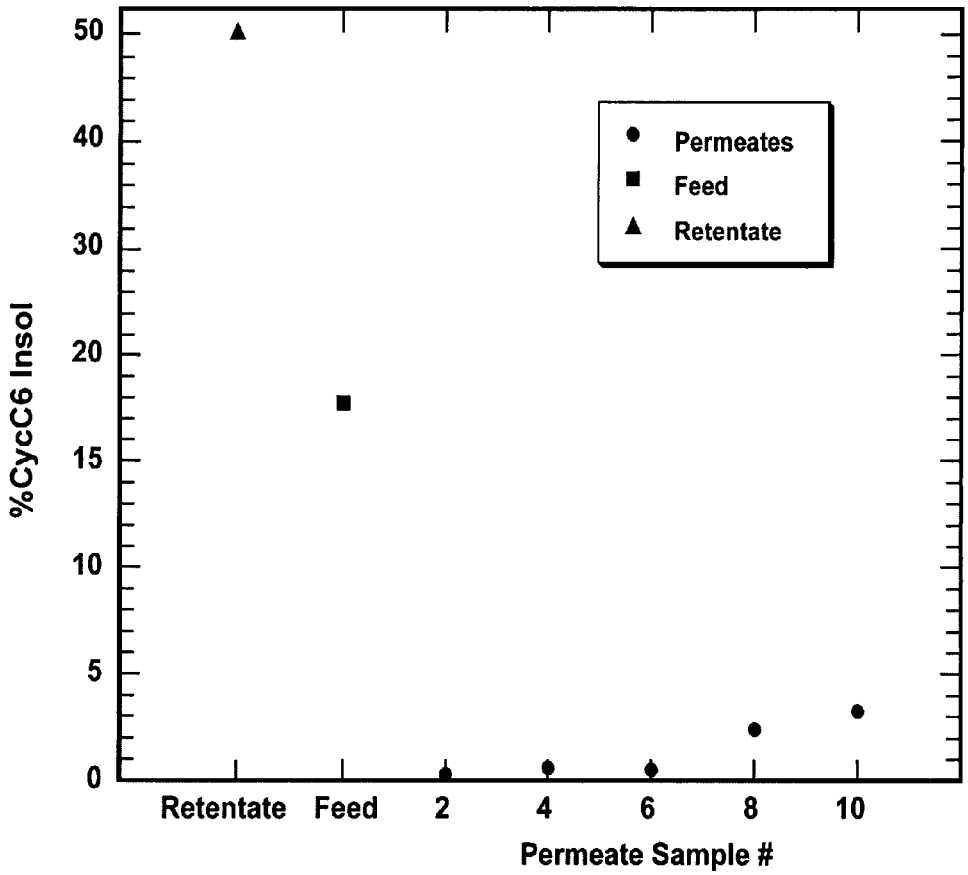
FIG. 4 hereof shows a graphic representation of the asphaltene content in the steam cracker tar feed, as well as the retentate and select permeate streams obtained from the process of the present invention.

Selected permeate samples along with the initial feed and final retentate from Example 2 above were tested for a reduction in asphaltenes by determining the fraction of sample insoluble in cyclohexane. The data is shown in Table 3 and also graphically in FIG. 4. The initial feed, retentate, and permeate sample numbers correspond to the same samples in Example 2 and Table 2.

TABLE 3

| Sample | Fraction Sample Insoluble in Cyclohexane (wt %) | % Decrease in Asphaltenes (as compared with Initial Feed) | % Increase in Asphaltenes (as compared with Initial Feed) |
|---|---|---|---|
| Initial Feed | 17.7 | | |
| Permeate Sample 2 | 0.3 | 98.3 | |
| Permeate Sample 4 | 0.6 | 96.6 | |
| Permeate Sample 6 | 0.5 | 97.2 | |
| Permeate Sample 8 | 2.4 | 86.4 | |
| Permeate Sample 10 | 3.3 | 81.4 | |
| Retentate | 50.0 | | 182.5 |

As can be seen in Table 3 above, the asphaltenes present in the steam cracker tar are significantly reduced in the permeate associated with the process of the present invention. In particular, an embodiment of the present invention results in a steam crack tar permeate product with at least a 25% reduction in cyclohexane soluble asphaltenes as compared to the steam crack tar feed. More preferably, the steam crack tar permeate product possesses at least a 50% reduction and even more preferably a 75% reduction in cyclohexane soluble asphaltenes as compared to the steam crack tar feed.

Example 4

In this Example, the initial feed and selected permeate samples from Example 2 above were tested for compatibility by automated titration for the steam cracker tar initial feed as well as Permeate Samples 9 and 10. The Insolubility Number, "$I_N$", for a sample is determined in accordance with the method disclosed in U.S. Pat. No. 5,871,634 to Wiehe et al. which is incorporated by reference herein. The results of these tests for the initial feed sample and select permeate samples is shown as the Insolubility Number ("$I_N$") in Table 4.

TABLE 4

| Sample | Insolubility Number ("$I_N$") | % Decrease in the Insolubility Number ("$I_N$") |
|---|---|---|
| Initial Feed | 90 | |
| Permeate Sample 9 | 59 | 34.4% |
| Permeate Sample 10 | 55 | 38.8% |

As can be seen from the Insolubility Numbers in Table 4, as well as the asphaltene reduction data from Table 3 of Example 3, not only do the steam cracker tar permeate products of the present invention have a reduction in asphaltenes, but the degree of aromaticity required to dissolve the remaining asphaltenes has been significantly reduced. This results in a steam cracker permeate product that is significantly more compatible for use as a blend stream for either fuel oils or bunker fuels or as a final product.

As can be seen in Table 4, one embodiment of the present invention results in a steam cracker tar permeate product with a % decrease in the Insolubility, $I_N$, of at least 20%, more preferably at least 25%, and even more preferably at least 30% as compared to the steam cracker tar stream prior to the ultrafiltration separation process.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for producing a product stream from a steam cracked hydrocarbon feed stream comprising:

a) thermally cracking a hydrocarbon feed stream in the presence of steam in an ethylene steam cracker furnace at a temperature of at least 1382° F. (750° C.) to produce a cracked product stream;

b) cooling the cracked product stream to a temperature below 1382° F. (750° C.);

c) fractionating the cracked product stream to produce at least a first fractionated product stream and a second fractionated product stream, wherein the second fractionated product stream has a higher final boiling point than the first fractionated product stream and the second fractionated product stream has a final boiling point greater than 1000° F. (538° C.);

d) inputting the second fractionated product stream into a membrane system wherein the second fractionated product stream contacts a first side of at least a first membrane;

e) passing a portion of the second fractionated product stream from the first side of the first membrane, through the first membrane, to a second side of the first membrane;

f) retrieving at least a first permeate stream from the second side of the first membrane; and g) retrieving at least a first retentate stream from the first side of the first membrane;

wherein the first permeate stream has a Micro Carbon Residue wt % that is at least 25% lower than the Micro Carbon Residue wt % of the second fractionated product stream.

2. The process of claim 1, wherein the second fractionated product stream is comprised of an ethylene steam cracker tar.

3. The process of claim 2, wherein the Insolubility Number ("$I_N$") of the first permeate stream is at least 20% lower than the Insolubility Number ("$I_N$") of the second fractionated product stream.

4. The process of claim 2, wherein the first membrane has an average pore size from about 0.001 microns to about 2 microns.

5. The process on claim 4, wherein the transmembrane pressure across the first membrane is from about 100 psig to about 1500 psig.

6. The process of claim 5, wherein the first permeate stream has a wt % of cyclohexane soluble asphaltenes that is at least 25% lower than the wt % of cyclohexane soluble asphaltenes of the second fractionated product stream.

7. The process of claim 6, wherein the temperature of the second fractionated product stream in the first membrane system is about 212 to about 662° F. (100 to 350° C.).

8. The process of claim 7, wherein the final boiling point of the first permeate stream is less than 1200° F. (649° C.).

9. The process of claim 7, wherein the second fractionated product stream is also comprised of an ethylene steam cracker gas oil.

10. The process of claim 7, wherein the Insolubility Number ("$I_N$") of the first permeate stream is at least 25% lower than the Insolubility Number ("$I_N$") of the second fractionated product stream.

11. The process of claim 7, wherein at least a portion of the first permeate stream is blended into a product selected from a fuel oil and bunker fuel.

12. The process of claim 7, wherein at least a portion of the first retentate stream is further processed in a petrochemical processing unit selected from a partial oxidation (POX) unit and a carbon black manufacturing unit.

13. The process of claim 6, wherein the first permeate stream has a Micro Carbon Residue wt % that is at least 40% lower than the Micro Carbon Residue wt % of the second fractionated product stream.

14. The process of claim 13, wherein the first permeate stream has a wt % of cyclohexane soluble asphaltenes that is at least 50% lower than the wt % of cyclohexane soluble asphaltenes of the second fractionated product stream.

15. The process of claim 13, wherein the transmembrane pressure across the first membrane is from about 250 psig to about 1200 psig.

16. The process of claim 15, wherein the first membrane has an average pore size from about 0.002 microns to about 1 micron.

17. The process of claim 16, wherein the Insolubility Number ("$I_N$") of the first permeate stream is at least 25% lower than the Insolubility Number ("$I_N$") of the second fractionated product stream.

* * * * *